US008510917B2

(12) United States Patent
Chen

(10) Patent No.: US 8,510,917 B2
(45) Date of Patent: Aug. 20, 2013

(54) TYING ARTICLE

(76) Inventor: Yao-Hsing Chen, Tainan (TW)

( * ) Notice: Subject to any disclaimer, the term of this patent is extended or adjusted under 35 U.S.C. 154(b) by 851 days.

(21) Appl. No.: 12/314,395

(22) Filed: Dec. 10, 2008

(65) Prior Publication Data

US 2009/0144944 A1 Jun. 11, 2009

(30) Foreign Application Priority Data

Dec. 10, 2007 (TW) ..... 96147067 A

(51) Int. Cl.
*B65D 63/10* (2006.01)

(52) U.S. Cl.
USPC ..... 24/16 PB; 24/17 B

(58) Field of Classification Search
USPC ..... 24/16 R, 16 PB, 17 A, 17 AP, 17 R, 24/713, 713.1, 17 B, 30.5 P; 206/805
See application file for complete search history.

(56) References Cited

U.S. PATENT DOCUMENTS 3,780,401 A * 12/1973 Reimer ..... 24/16 PB
3,882,573 A * 5/1975 Thomas, Jr. ..... 24/30.5 T
3,914,823 A * 10/1975 Hara ..... 24/16 PB
3,918,129 A * 11/1975 Hara ..... 24/16 PB
3,943,607 A * 3/1976 Hara ..... 24/16 PB
6,442,806 B1 * 9/2002 Wesson ..... 24/573.11
6,606,765 B2 * 8/2003 Edmondson ..... 24/265 CD
6,678,921 B2 * 1/2004 Despault et al. ..... 24/16 PB
2007/0186388 A1 * 8/2007 Rome ..... 24/16 PB

FOREIGN PATENT DOCUMENTS

JP 2005329949 A * 12/2005

* cited by examiner

*Primary Examiner* — James Brittain
(74) *Attorney, Agent, or Firm* — Bacon & Thomas, PLLC

(57) ABSTRACT

A tying article which is formed into one piece used for tying objects, where the tying article has at least two sets of all-in-one ratchet sets at its surface, which are distributed along two sides separated by boundary pieces and each side has at least one bar-like bodies, where the ratchet set of each bar-like bodies is made up of at least two ratchets. When binding an article, the tying article can be divided into two parts. The first part is the enclosing part that loops the tied article, and the second part is the extending part that protrudes from the enclosing part. The extending part is again divided into two branches, where the seizing face of a corresponding ratchet of each branch is clenched by the enclosing part served as a detent. Once the binding works, the extending part tends to shrink back, but the seizing face of the ratchet is clenched by the enclosing part served as the detent, which enables a tight binding between the two and an adjustable binding as well.

4 Claims, 9 Drawing Sheets

TYING ARTICLE

BACKGROUND OF THE INVENTION

1. Field of the Invention

The present invention relates to tying articles more particularly to one having at least two sets of ratchet sets that are all-in-one formed at its surface, which are distributed along two bar-like bodies separated by a boundary piece, where each of the ratchet sets on the bar-like bodies is made up of at least two ratchets. During binding a tied article, an enclosing part is formed to loop the tied article and an extending part is formed to protrude from the enclosing part, and the extending part is divided into two branches, where the seizing face of a corresponding ratchet of each branch is clenched by the enclosing part served as a detent, which enables a tight binding and an adjustable binding as well.

2. Description of the Prior Art

Among the prior art tying articles that are used for binding a bag hole (for instance: a bag filled with food to be tied at its hole), the article called "rubber band" gains the most popularity. FIG. 1 shows a three-dimensional appearance of a prior art tying article 1, which is formed out of soft rubber substances, and it appears a ring shape most of the time. The operation of its binding is shown in FIGS. 2 & 3. By means of the elasticity of the tying article, it is being stretched outward into juxtaposition, followed by looping it around the hole of a bag 2, and passing one end through the inside of the other end. Lastly, the extended portion is being pulled for tightening, which makes the tying article tightly bind the bag 2, and this is for sure the live experience known by everybody.

Referring to FIGS. 2 & 3, as the tying article 1 binds the tied article with a tight pull, the tying article 1 can be marked into two parts. The first part is the enclosing part 11 that loops the tied article, which has a terminal 111, and the second part is the extending part 12 that protrudes from the terminal 111 of the enclosing part 11, where the extending part 12 is apparently divided into two branches 121 and 122. The enclosing part 11, the terminal 111, the extending part 12 and the branches 121 and 122 are determined by the different action positions for an arbitrary use. As the using state is released and returns to the ring-shaped tying article 1 in FIG. 1, which is then unable to recognize where are the enclosing part 11 and the terminal 111? Where are the extending part 12 and the branches 121 and 122? Once the tying article 1 is used again, it is immediately again to recognize the enclosing part 11, the terminal 111, the extending part 12, and the branches 121 and 122.

Though the prior art tying articles 1 exist long and are used broadly by the masses as the article for binding purpose, they have considerable drawbacks for the actual uses, which is because the tying article 1 is provided with elasticity and lacking of any detents at its smooth surface. During the use, it is possible that the tying article 1 will gradually loosed due to its resilience and come off eventually (shown in FIG. 4). Comparing FIG. 3 to FIG. 4, it is apparent that the extending part 12 in FIG. 3 is longer while the extending part 12 in FIG. 4 is shrunk back gradually to the inside of the terminal 111, becoming part of the enclosing part 11. As the extending part 12 gets shorter and the enclosing part 11 gets looser, the bag 2 is gradually loosing its binding, which substantially affects the freshness of the food in the bag 2 or makes the stuff in the bag 2 to drop, and this is the serious structural drawback that is unable to overcome. To prevent the happening of the loose binding shown in FIG. 4, people will make several knots for the extending part 12 after completing binding, making the binding spot hard to come off. On the other hand, this brings about extra efforts to release the knots in the future—even adopting the destructive ways as cutting off or pulling apart forcefully to release them, which is not only unhandy but unavailable for the repeated use. Aside from the so-called "rubber band", the tying articles used for binding the hole of bag usually adopt plastic ropes. In early days the plastic rope is being cut into several shorter segments, and one segment is taken for use once a binding is demanded. The operation is mainly to knot directly, and one knot for the desire of later use, while multiple knots either for tight binding or for no more unbinding. The drawback is even one knot, and it could still be loose gradually if it is a running knot, and it could be trouble in unbinding if it is a fast knot. For the multiple knots, it is only available to untie by cutting off them, which is not perfect too. Some manufactures later on made the plastic ropes into rings, and the way of binding by the plastic ring is similar to that of the rubber band, which could have the drawback of worse tightness for the binding (worse than the rubber band), and the drawback of being loosed gradually (due to the tension of tightly tied plastic rope). On the other hand, if the binding is too tight (multiple knots), it has the drawback of being difficult to untie them, which deteriorates the usage too. Under the circumstance of having no better tying articles, the use of the rubber band and the plastic ring is still the popular way nowadays.

No matter it is a rubber band or a plastic rope, its surface looks not entirely smooth under a microscopic view. During the use, the force exerted by the pulling or by the tension of the enclosing part 11, will enable the extending part 12 to pass or return the terminal 111 (shown in FIGS. 3 & 4), without being seized by any detents. Therefore, the prior art tying articles are considered as being continuously level for their body surfaces, and this is the common ground in the structure of the prior art tying articles.

SUMMARY OF THE INVENTION

In the light of the drawbacks of the use of the prior art tying articles, this inventor conceived the idea for the improvement, expecting to offer a tying article capable of handling the elasticity with ease, and eventually the manifold endeavors gave birth to this invention.

The objective of the present invention is to provide a tying article that is handy in manipulating binding for a sound outcome of tightness, and also handy in manipulating unbinding at any time.

The other objective of the present invention is to provide a tying article that features adjustable binding during the manipulation of the tying motions, and to suit the use in different binding ranges.

To accomplish the above objects, the tying article of the present invention is formed into one piece used for tying object, where the tying article has at least two sets of ratchet sets that are all-in-one formed at its surface, which are distributed along two sides separated by boundary pieces and each side has at least one bar-like body, where the ratchet set of each bar-like body is made up of at least two ratchets, When the tying article being in horizontal stick-like form condition, the seizing faces of the ratchets of the same ratchet set on each bar-like body are all facing to the same boundary piece, When binding an article, the tying article can be divided into two parts. The first part is the enclosing part that loops the tied article, and the second part is the extending part that protrudes from the enclosing part; where the extending part is again divided into two branches, where the seizing face of a corresponding ratchet of each branch, clenched by the enclosing part, faces the enclosing part, which makes the ratchet seize the enclosing part that is served as the detent, to prevent the shrinking of the extending part.

In the aforementioned invention, the tying article is shaped into a loop-like form. In the aforementioned invention, once the tying article is shaped into a loop-like form, two different sides are separated by boundary pieces where each side has at least one bar-like body which is connected with the boundary piece. Once force is exerted on the boundary piece to put the bar-like bodies in juxtaposition, the arrangement of the ratchets of every ratchet set on the bar-like bodies is based on the manner that the seizing faces of the ratchets of the same ratchet set on each bar-like body are all facing the same boundary piece, and the seizing faces of the ratchets of every ratchet set at the same edge on the bar-like bodies are all facing the same boundary piece.

In the aforementioned invention, the tying article is shaped into a bar-like form. In the aforementioned invention, once the tying article is shaped into a bar-like form, two different sides are separated by boundary pieces, and each side has at least one bar-like bodies, where the arrangement of the ratchets of every ratchet set is based on the manner that the seizing faces of the ratchets of every ratchet set on each bar-like bodies are all facing the same boundary piece, and the boundary piece is located between the ratchet sets of different sides.

In the aforementioned invention, the enclosing part of the tying article, featuring in looping the tied article, provides detents which correspond to the seizing faces of the ratchets located in at least two branches of the extending part to seize each other, and the detent functions the same even after it rotating for some angle. In the aforementioned invention, the included angles between the horizontal central line of the tying article body and a face of the ratchet will be ≦90 for one, and >90° for the other.

DETAILED DESCRIPTION OF THE INVENTION

To achieve the foregoing objects of the present invention, the techniques adopted and the achievable functioning are detailed described with reference to the following preferred exemplified embodiments and the accompanying drawings, which helps a thorough comprehension of the present invention.

Figure 1:
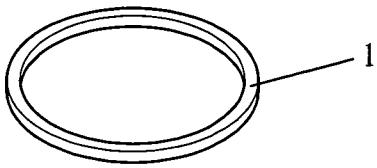
FIG. 1 (PRIOR ART)
FIG. 1 is a three-dimensional exterior view of a prior art tying article.
Figure 2:
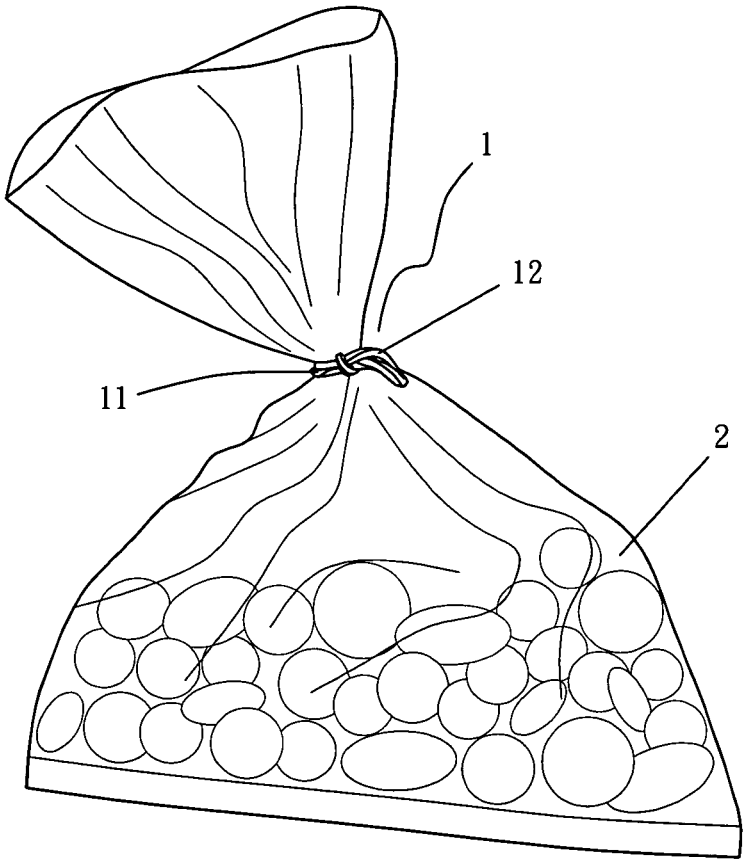
FIG. 2 (PRIOR ART)
FIG. 2 is a three-dimensional schematic view of a prior art tying article binding on a bag.
Figure 3:
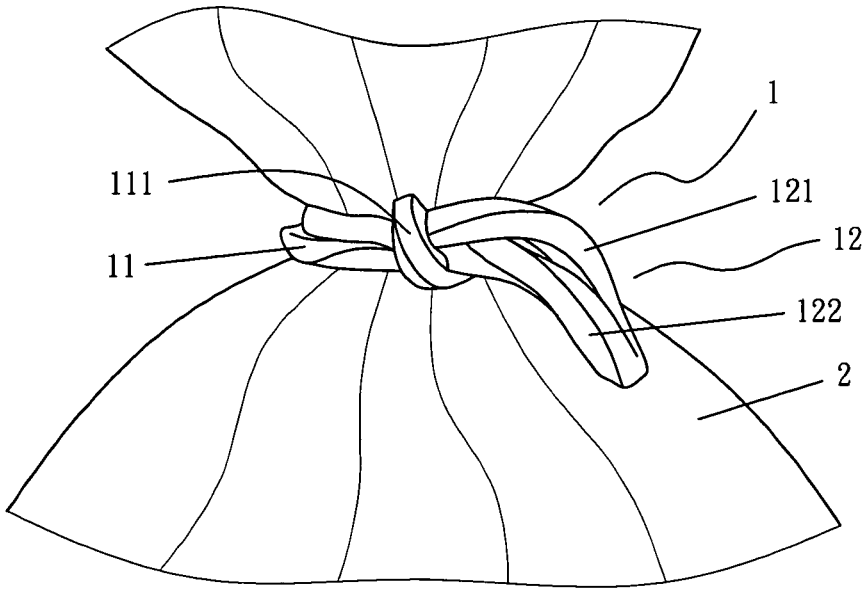
FIG. 3 (PRIOR ART)
FIG. 3 is a partial enlargement of FIG. 2.
Figure 4:
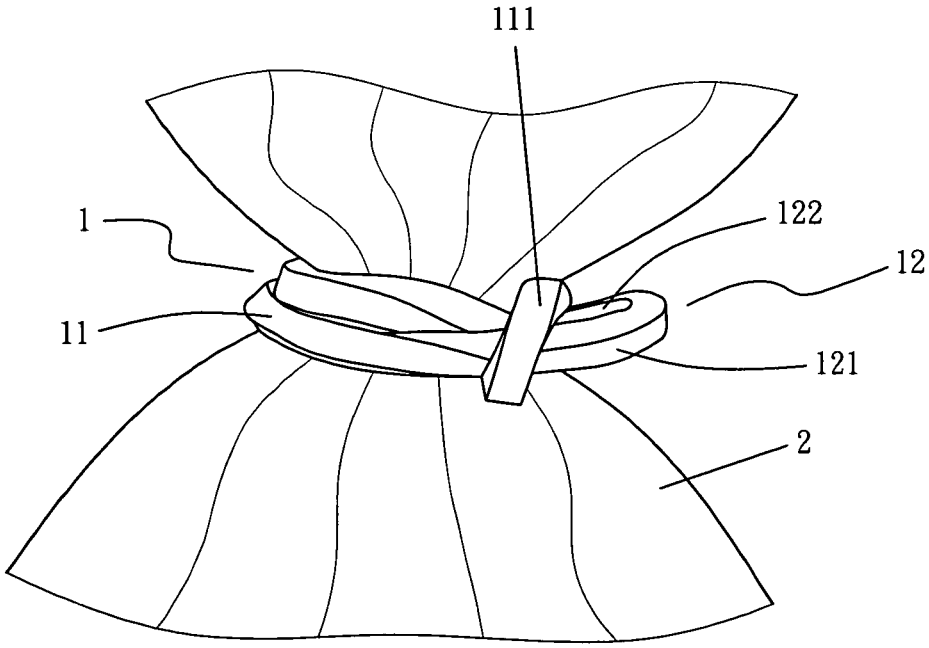
FIG. 4 (PRIOR ART)
FIG. 4 is a three-dimensional schematic view of a prior art tying article binding on a bag and the tying article gets loose gradually.
Figure 5:
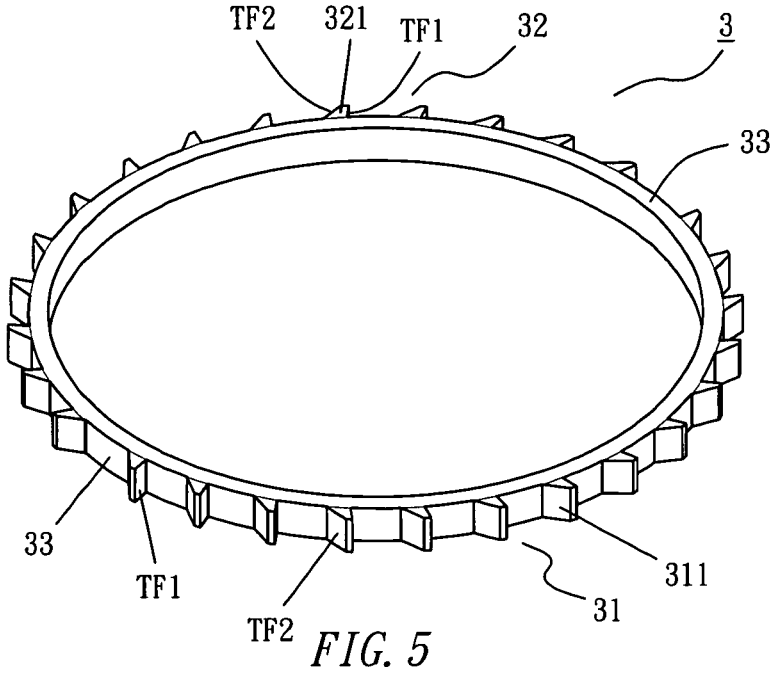
FIG. 5 is a three-dimensional exterior view of the first exemplified embodiment of the present invention.

Referring to FIG. 5, the tying article 3 of the first exemplified embodiment of the present invention is shaped all-in-one into a loop-like form (a loop-like form could be a circle, a square or other shape), and it's better made of soft rubber for the elasticity, but not excluding other substances or composite materials, for instance: shaping by using fiber, resin material or non-woven material; or the tying article 3 is made of metal based composite material for having flexibility and minute resiliency. The tying article 3 is characterized by different ratchet sets 31, 32 which are lined up on the outer edge of its body, where the ratchet sets 31, 32 each comprises a plurality of successive ratchets 311 and 321 in order, and a boundary piece 33, apparently differentiated from the ratchet, separates the ratchet set 31 from the ratchet set 32. After the tying article 3 is formed, it presents naturally a ring shape shown in FIG. 5 under an independent situation without any external force. It is apparent that the ratchet set 31 stands on a bar-like body, while the ratchet set 32 stands on another bar-like body, and these two bar-like bodies are separated and connected by the two boundary pieces 33. In other words, these two bar-like bodies are located on the two sides separated by any of the boundary pieces 33, and each of the two sides, separated by any of the boundary pieces 33, has at least a bar-like body. As the two boundary pieces 33 are stretched outward by the hands to place the two bar-like bodies in juxtaposition, the whole shape of the tying article 3 will show the joined state in FIG. 6, and it will recover the state in FIG. 5 once releasing the hands.

Plural parameters related to the ratchet of this application are defined herein. FIG. 7 is an enlargement of a small segment of the ratchet sets 31, 32 in FIG. 6, where the tying article 3 has a body MB shaped in horizontal stick-like body, and the body has a horizontal central line BL. Based on the horizontal central line BL, each ratchet 311, 321 has a steep slope side, a seizing face TF and a smooth slop side, a slipping face TF2. The included angle AN1 between the horizontal central line BL and the seizing face TF1 must be ≦90, and the included angle AN2 between the horizontal central line BL and the slipping face TF2 must be >90°. The seizing face TF1 is the one that will effectively seize the detent served by the enclosing part, and that is the reason to be named "seizing face", while the slipping face TF2 is the one that will let the tying article to slip off during the binding, and thus to be named "slipping face".

Figure 6:
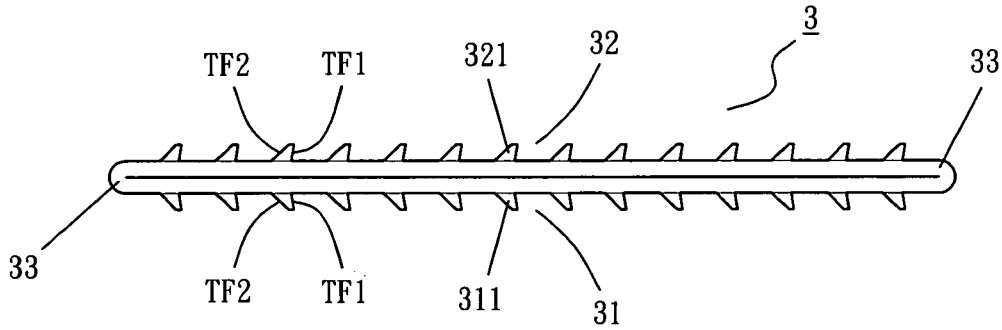
FIG. 6 is a top view of a tightly stretched in juxtaposition for the first exemplified embodiment of the present invention.
Figure 7:
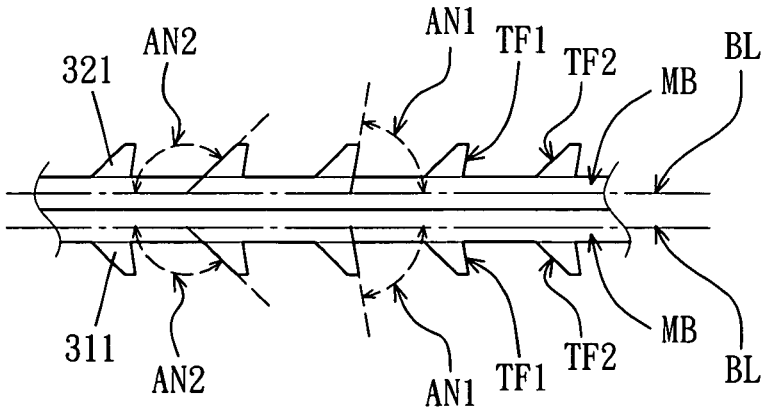
FIG. 7 is a schematic diagram of the definition of the related parameters in all exemplified embodiments of the present invention.

The tying article 3 is exerted by the force to stretch into the state shown in FIG. 6. Suppose one boundary piece 33 is regarded as an terminal, the ratchet sets 31, 32 that are laid together are located on two bar-like bodies and shaped a line respectively which are separated by the boundary pieces 33, and the seizing faces TF1 of the ratchets 311, 321 of the ratchet sets 31, 32 are all facing the same boundary piece 33. The use of the tying article 3 starts by stretching it into the juxtaposed mode shown in FIG. 6 followed by the binding of the tied article, and holding the boundary pieces 33 by the two hands respectively. Similar to the manipulation of putting prior art rubber band around, raise the left boundary piece 33 (based on the direction of FIG. 6), to move up and rotate right to penetrate through the inside of the winding formed by the right boundary piece 33 with a twist, which enables the seizing faces TF1 of the ratchet sets 31, 32 to face the corresponding ratchets 311, 321 on the winding, and it is done only by a pull for the fastening.

Figure 8:
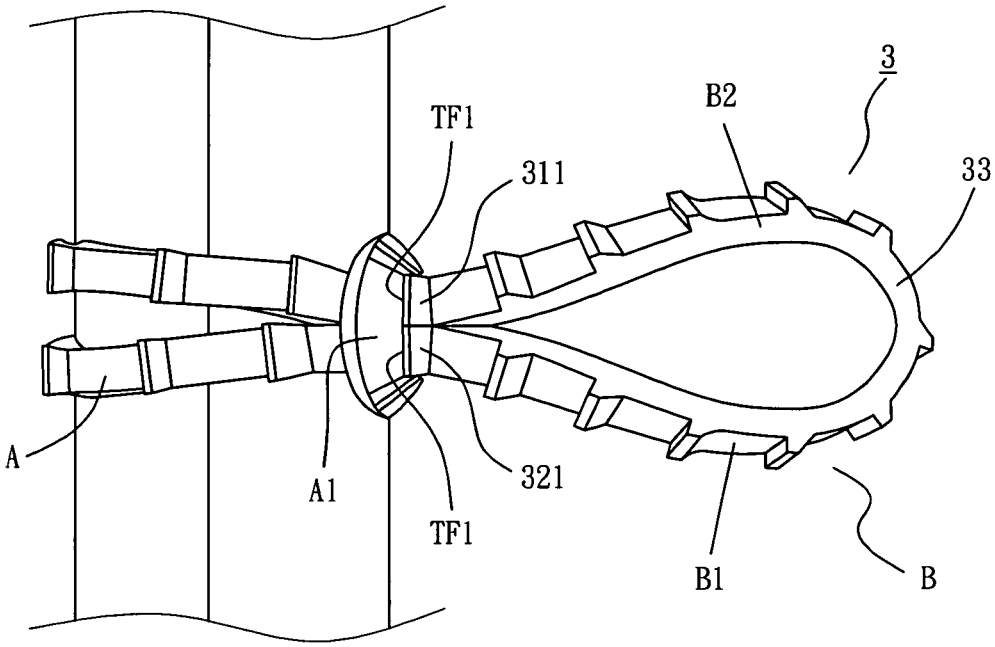
FIG. 8 is a schematic diagram of the status for the use of the first exemplified embodiment of the present invention.

The tying article 3 once completing the binding is shown in FIG. 8. The tying article 3 in binding state (stretched state) can be divided into two parts. The first part is the enclosing part A that loops the tied article, and a boundary piece 33 is formed into a terminal A1 of the enclosing part A. The second part is the extending part B which is protruded from the terminal A1 of the enclosing part A. The extending part B is further divided into two branches B1 and B2, which are separated each other by another boundary piece 33, where the branches B1 , B2 include some of the ratchets 311, 321 of the ratchet sets 31, 32 respectively. The rest of the ratchets 311, 321 that do not belong to the extending part B become the body or part of the enclosing part A. The farthest parts of the branches B1, B2 of the extending part B are connected each other by a boundary piece 33. The portion of the seizing faces TF1 of the ratchets 311, 321 of the ratchet sets 31, 32 belonged to the extending part B will face the terminal Al (a boundary piece 33) of the enclosing part A; therefore, the terminal A1 forms a detent that offers the seizing face TF1 of the ratchets 311, 321 of the ratchet sets 31, 32 to be clenched by the corresponding terminal Al Strictly speaking, the terminal Al, clenched with the corresponding ratchets 311 and 321, has two clenching locations, and these two clenching locations will shift a bit subject to the degree of binding strength, which means the detent is not a fixed location, it is a variable range instead. The clench with respect to the detent can be a unidirectional tightening, since the tightening is done as the slipping faces TF2 of all the ratchets 311, 321 face the terminal A1, and the slipping faces TF2 are unable to clench with the terminal Al, such that the slipping faces TF2 are easy to pass through the terminal Al during the pulling, which makes the pulling be a unidirectional tightening and more tight for more pulling. Once the pulling is released at any tightness, the seizing faces TF1 of a corresponding set of the ratchets 311, 321 will clench with the terminal A1 , the detent, for the tightening. Different tightness means different ratchets 311, 321 that correspond with the terminal A1 for the clench.

Since the tying article 3 is formed out of flexible and resilient substance, the use allows arbitrary rotate or twist of it. Each ratchet set 31 or 32 are made up of at least two ratchets 311, 321 and shaped in line. Once for binding, the enclosing part A, which is looping the tied article, tends to pull the extending part B back to the enclosing part A due to its tension from the stretch. But the seizing faces TF1 of the ratchets 311 and 321 correspond to the branches B1 and B2 of the extending part B are blocked by the terminal A1 (part of the enclosing part A), the detent, for unable to shrink back. The slipping face TF2 of the enclosing part A is easy to pass through the terminal A1. Once it passes the seizing face TF1 is clenched to avoid return, which enables the tightening to be a unidirectional, and accomplishes the binding purpose. To release the binding, a pull (shake) is needed on the tightening location, the detent, (possibly is the boundary piece 33 or part of the enclosing part A), which looses the clench between the portion served as detent and the corresponding ratchets 311 and 321, for the release of the whole binding.

Apparently, the thing served as the detent is not necessary to be the boundary piece 33. Once a portion is able to clench with the seizing faces TF1 of the corresponding ratchets 311 and 321 of the ratchet sets 31 and 32 for a binding is qualified to be the detent. Even a part of the enclosing part A is viable, which means the detent could be served by a region, instead of a fixed spot. Moreover, the thing served as the detent is not limited by a certain angle. Because the tying article 3 is formed out of resilient substance, even the enclosing part A is twisted for a certain angle before the binding, there must be a portion facing the seizing faces TF1 of the corresponding ratchets 311 and 321 on the branches B1 and B2 of the extending part B, where the portion is served as the detent. In other words, as long as a portion is able to clench the seizing face TF1 of the corresponding ratchet 311, 321 on the branches B1 and B2 of the extending part B is construed as the detent.

Figure 9:
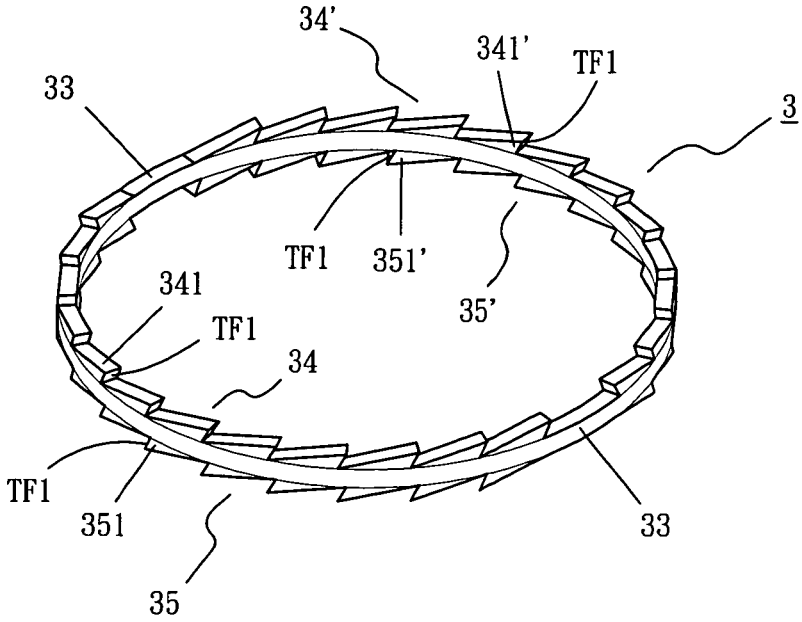
FIG. 9 is a three-dimensional exterior view of the first modified example of the first exemplified embodiment of the present invention.

FIG. 5 shows a tying article formed into a ring that could have many varieties, which are all included in the scope of the claim of this invention, for instance, the varieties are shown in FIGS. 9-13. FIG. 9 shows that the body has apparently many different ratchet sets that are arranged in order, which include the ratchet sets 34 and 34' on the top edge of the body and the ratchet sets 35 and 35' on the bottom edge of the body, where the ratchet sets 34 and 34' on the top edge of the body (at the same edge) have a boundary piece 33 looked apparently different from the ratchet as the divider, and the ratchet sets 34 and 34' each has multiple ratchets 341, 341' arranged in order. The ratchet sets 35 and 35' on the bottom edge of the body (at the same edge) have a boundary piece 33 as the divider, and the ratchet sets 35 and 35' each has multiple ratchets 351, 351' arranged in order. FIG. 9 shows that a tying article 3 will form a ring naturally under the circumstance of being an independent state and without any external force. At this moment, it is apparent that the body on which the ratchet set 34, 35 are located is a bar-like body, and the body on which the ratchet set 34', 35' are located is another bar-like body, where these two bar-like bodies are connected and divided by two boundary pieces 33. Once the binding is effective, the branches B1 and B2 of the extending part B also have the ratchet that seize with the terminal that being served as the detent) of enclosing part, and the seizing faces TF1 of the ratchets face to the terminal of enclosing part so as to produce the detent effect. If the tying article 3 of the FIG. 9 being in tying effect condition, wherein the arrangement of ratchets would be that the ratchet sets which contact the detent and the ratchet sets which contact the tied article are located on the top and the bottom edge of the tying article 3 in the same bar-like body, that is the direction of the arrangement of the ratchets are contrary, and the seizing faces TF1 of the ratchet which contact the tied article will face to the tied article. But it will not affect the work of tightening effect, due to the extending part were pulling out in the tightening effect, the traction will pull the two branches up forward to the detent (not forward to the tied article) in the same time. That is the two bar-like bodies were pulled away from the tied article which near the detent. So, when the tying article were pulling up, the ratchet which contact the tied article will move up and outside with it so as to avoid the obstruction of the tied article. Then it will not affect the work of tightening effect.

Figure 10:
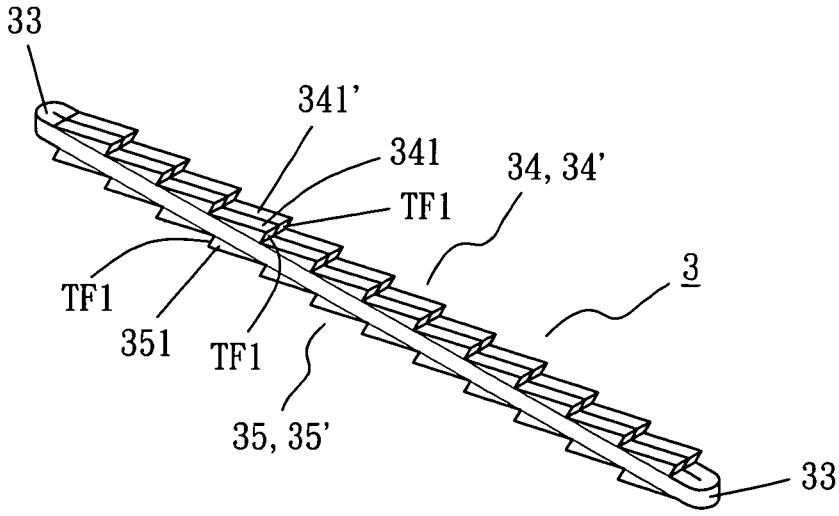
FIG. 10 is a three-dimensional exterior view of the tying article in FIG. 9 that is being tightly stretched in juxtaposition.

The tying article in FIG. 10 is formed by holding the two boundary pieces 33 by the hands and stretching out with force to juxtapose the two bars. At the moment, taking one boundary piece 33 as a terminal, it is apparent that the ratchet sets 34 and 34' adjoined to each other on the top edge are in the shape of a line, where both stand on the two bar-like bodies at different sides of the boundary piece 33, and the ratchets 341, 341' of the ratchet sets 34, 34' are arranged toward the same direction, where their seizing faces TF1 are facing the same boundary piece 33. In the same measure, it is apparent that the ratchet sets 35 and 35' adjoined to each other on the bottom edge are in the shape of a line, where both stand on the two bar-like bodies at different sides of the boundary piece 33, and the ratchets 351, 351' of the ratchet sets 35, 35' are arranged toward the same direction, where their seizing faces TF1 are facing the other boundary piece 33. The ratchets 341, 351 of the ratchet sets 34, 35 located at opposite edges of the same bar-like body are arranged toward different directions, and facing different boundary pieces 33. Similarly, the ratchets 341', 351' of the ratchet sets 34', 35' located at opposite edges of the same bar-like body are arranged toward different directions, and facing different boundary pieces 33.

Figure 14:
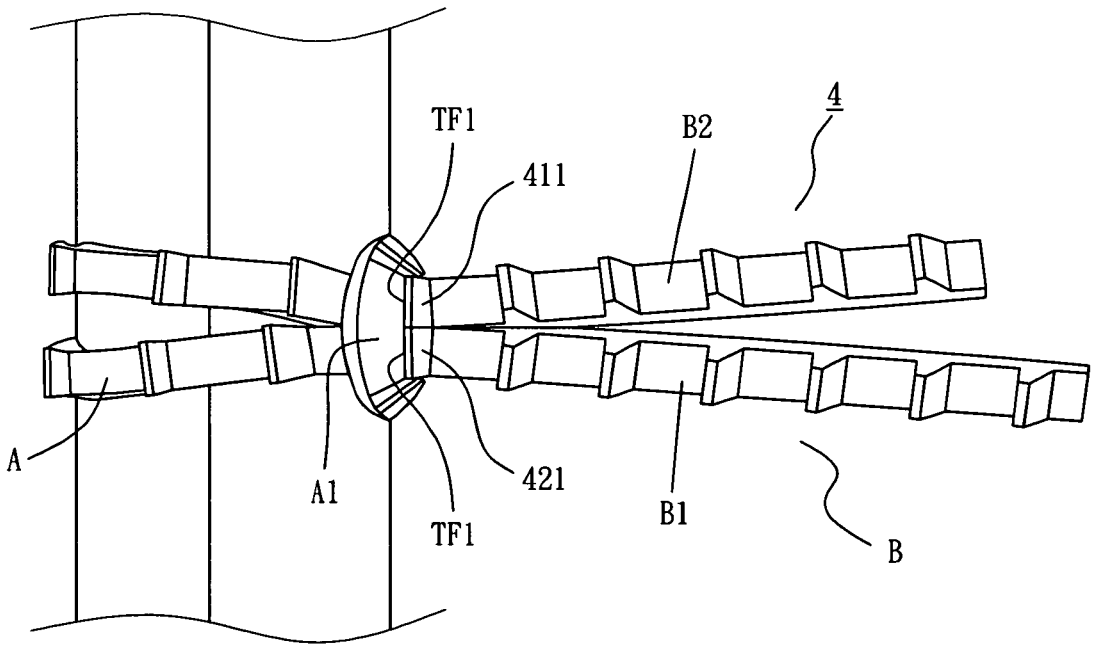
FIG. 14 is a schematic diagram of the status of the first usage of the second exemplified embodiment of the present invention.
Figure 11:
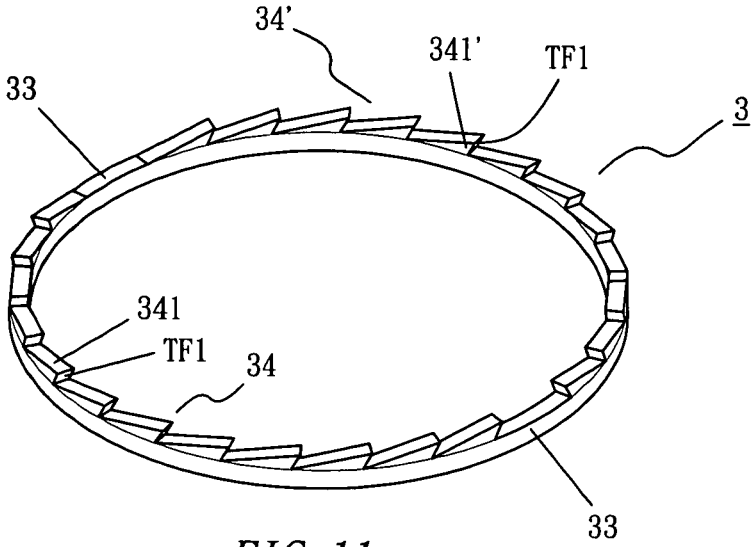
FIG. 11 is a three-dimensional exterior view of the second modified example of the first exemplified embodiment of the present invention.
Figure 12:
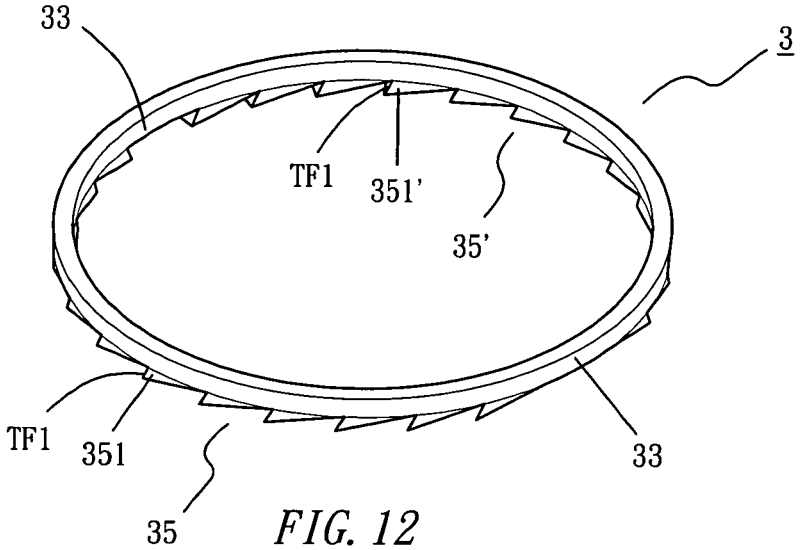
FIG. 12 is a three-dimensional exterior view of the third modified example of the first exemplified embodiment of the present invention.
Figure 13:
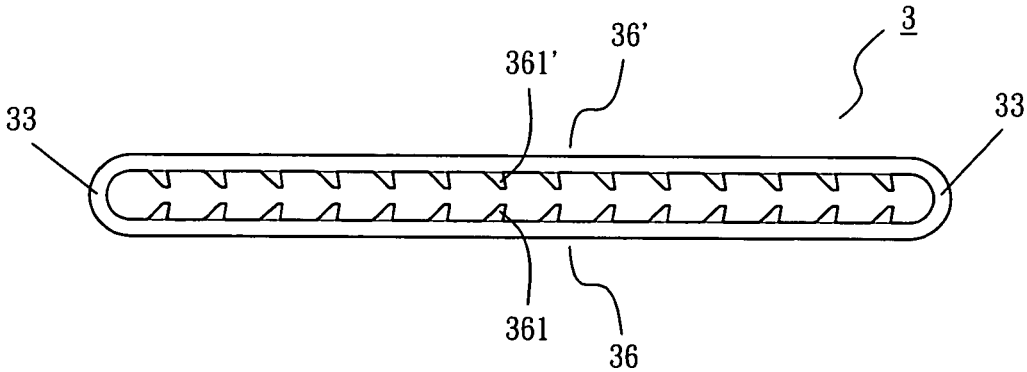
FIG. 13 is a top view of the fourth modified example of the first exemplified embodiment of the present invention.

FIG. 11 is the one that remains the ratchet sets 34, 34' at the top edge (the seizing faces TF1 are facing the same boundary piece 33 for the stretching mode), where the bottom edge has no ratchet set setup. FIG. 12 is the one that remains the ratchet sets 35, 35' at the bottom edge (the seizing faces TF1 are facing the same boundary piece 33 for the stretching mode), where the top edge has no ratchet set setup. FIG. 13 shows the tying article 3 shaped a loop-like form which is provided with apparently different ratchet sets 36, 36' arranged in order on the inner edge of the tying article 3. Each has multiple successively arranged ratchets 361, 361', and both are connected and divided by the boundary pieces 33 that are apparently different from the shape of the ratchet. FIG. 13 shows the shape formed by stretching out from both boundary pieces 33 of the original loop-like form shape of the tying article 3, which forces the two bar-like bodies together with the ratchet sets 36, 36' to be in juxtaposition. Since the two ratchet sets 36, 36' are both located on the inner edge of the tying article 3, and the seizing faces TF1 of the ratchets 361, 361' are facing the same boundary piece 33; therefore, the way to bind article is the same as that in FIG. 6. With a minute twist to the two branches of the extending part to juxtapose the ratchets 361 and 361', and the seizing faces TF1 are facing the enclosing part, which enables the seizing faces TF1 of the ratchets 361, 361' and the detent to clench each other. Apparently, the achieved functions of the four varied examples in binding an article shown in FIGS. 9~13 are exactly the same as in FIG. 5. If the farthest boundary piece 33 of the extending part B in FIG. 8 is being cut off, a state of two branches B1 and B2 that are disconnected in the farthest side is formed in FIG. 14. FIG. 14 shows that the binding is same as that in FIG. 8 (the tightening doesn't change). Suppose the binding is released in FIG. 14, a bar-like form tying article 4 is formed in FIG. 15, which is the second exemplified embodiment of the present invention. The tying article is made out of various single or composite substances, and it features flexibility and resilience after shaping. The tying article 4 has a boundary piece 43 at its center, and a bar-like body is extended to each of the right and left side (different sides), where the same edge of the two bar-like bodies is provided with ratchet sets 41, 42 (arranged in line) which are arranged in different directions and separated by the boundary piece 43. Each bar-like body has multiple successively arranged ratchets 411, 421, and the seizing faces TF1 (same definition as in FIG. 7) of the ratchets 411, 421 are facing the same boundary piece 43.

Figure 15:
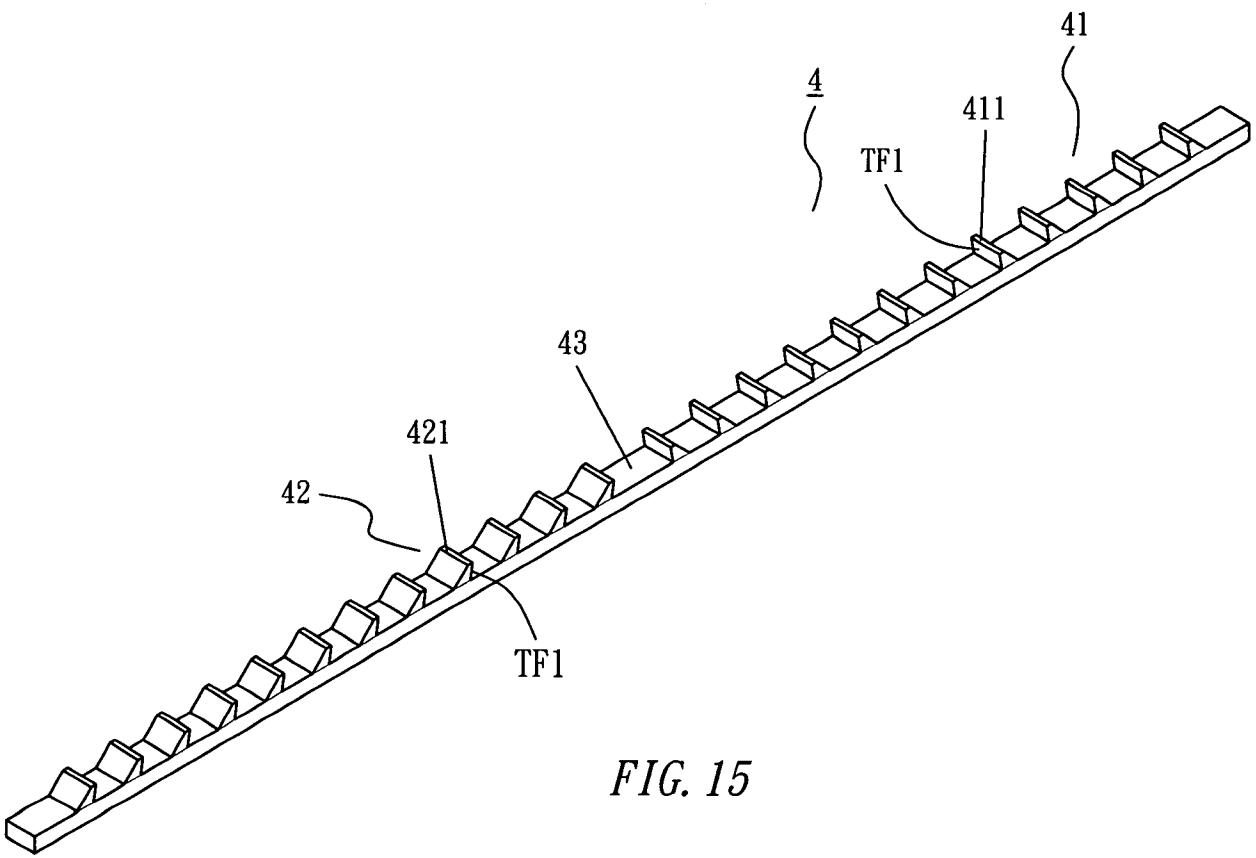
FIG. 15 is a three-dimensional exterior view of the second exemplified embodiment of the present invention.
Figure 16:
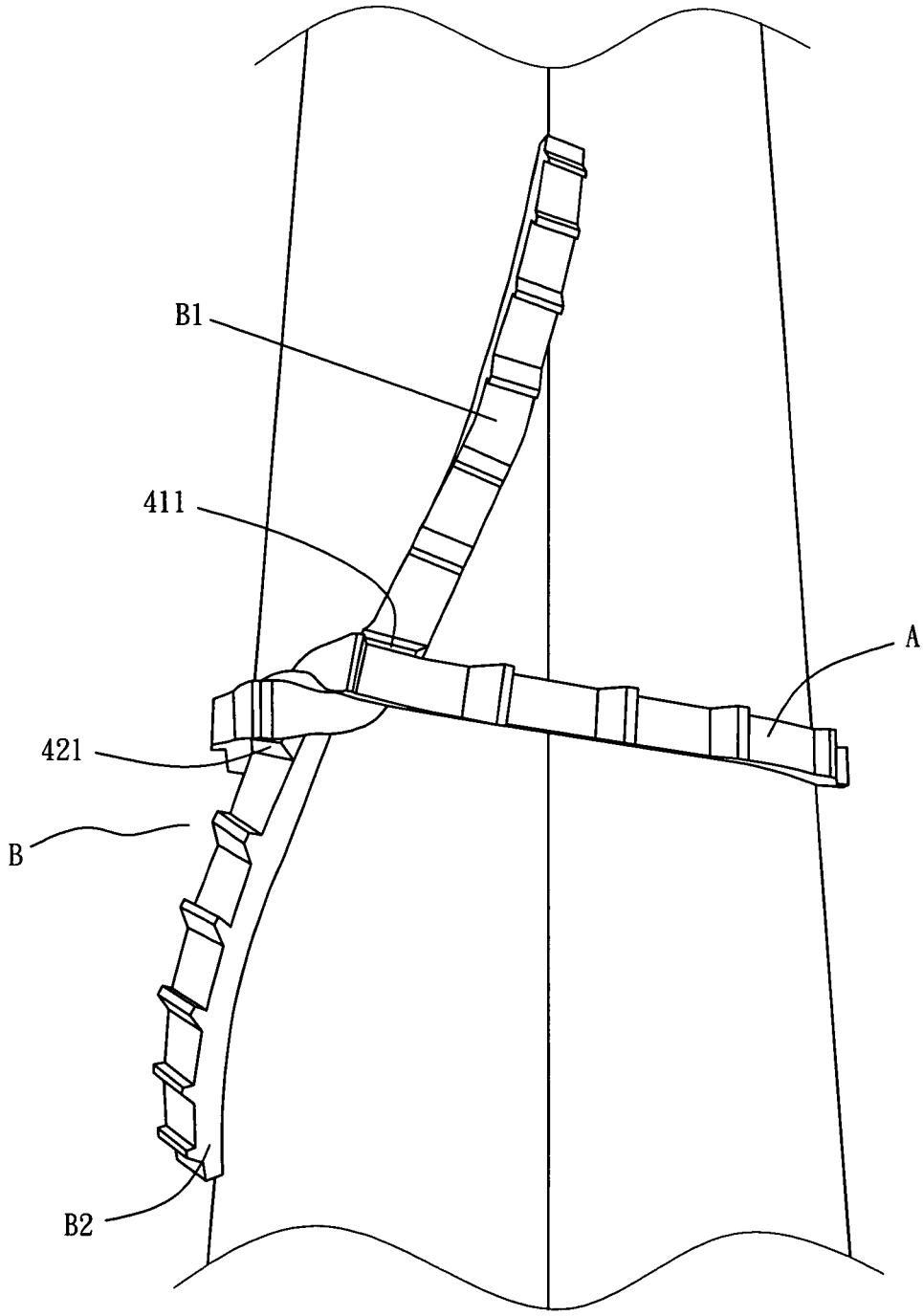
FIG. 16 is a schematic diagram of the status of the second usage of the second exemplified embodiment of the present invention.

As the bar-like form tying article 4 in FIG. 15 is used for binding, it could have two ways for the manipulation. The first way is to bend the bar-like form tying article 4 at its boundary piece 43 to juxtapose the two bar-like bodies, and follows the binding procedure exactly same as the first exemplified embodiment, which is then the binding shown in FIG. 14. The second way is to knot the bar-like form tying article 4 in looping around the binding place with a tightening, which are then the binding shown in FIG. 16. It is clear from FIG. 16 that the tying article 4 in knotting-typed binding can be divided into two parts. The first part is the enclosing part A that loops the tied article (boundary piece 43 belongs to the enclosing part A). The second part is the extending part B which is protruded from the enclosing part A. The extending part B is further divided into two branches B1 and B2, where the branches B1, B2 extend into different directions, and the branches B1, B2 are separated from each other and not connected.

Once the tying article 4 is tightened, the enclosing part A is subject to tension due to the tightening. The tying article 4 is elastic so that the resilient force will render the two branches B1 and B2 the power to shrink toward the tied article. However, the two branches B1 and B2 each has at least two corresponding ratchets 411 and 421, where the seizing faces TF1 of them all face the enclosing part A. Therefore, as soon as the two branches B1 and B2 shrink backward, the seizing faces of their corresponding ratchets 411 and 421 will be clenched by a distinct region of the enclosing part A which serves as the detent, which achieves the tightening, and the binding won't be loosed by itself as time goes by. If the tying article 4 is pulled to be more tight, the detent confronts only the slipping face TF2 (definition same as in FIG. 7) of the ratchet, so that the distinct region of the enclosing part A will no doubt let the slipping faces TF2 of the ratchet to pass, which means the corresponding ratchets 411 and 421 at the two branches B1 and B2 responsible for the clench with the detent will be altered, and the corresponding position of the detent is also altered, for the better adjustment of the degree and range of the tightness. As the tightening movement stops, the detent immediately encounters the seizing face TF1 for the clench, which immediately ceases shrinking back.

Any distinct region that corresponds to the ratchets 411 and 421 of the ratchet sets 41 and 42 on the two branches B1 and B2 of the extending part B and the enclosing part A of the tying article 4 is available to serve as the detent, which means the one serves as the detent can be a region, not a fixed spot instead. Because the tying article 4 is flexible, the distinct region corresponding to the ratchets 411 and 421 for the clench appears various rotated and twisted shapes. However, every portion that has been twisted for some angle is available to be the detent, which is responsible for stopping the ratchets 411 and 421 from moving backward.

Once the size of the tied article is changed, the corresponding ratchets 411 and 421 of the tying article 4 for the clench and the position of the detent are also changed. For instance, the ratchets 411 and 421, which originally belongs to a portion of the enclosing part A, will be pulled outward accompanied by the two branches B1 and B2 for more tight binding, and becomes the corresponding ratchets 411 and 421 of the two branches B1 and B2 that clench the shrunk enclosing part A. Reversely, the ratchets 411 and 421, which originally belongs to the two branches B1 and B2, will be pulled inward into the range of the enclosing part A for more loose binding (for instance: add other tied article), and will become a portion of enlarged enclosing part A, which makes it handy for adaptively adjusting the binding subject to different size of the tied article. As for releasing the binding of the tying article 4, it simply use the finger to dig out the locations that the ratchets 411 and 421 clenched the detent, to loose the binding and eventually make it come off, followed by opening up the knots, which is damned handy in use.

Figure 17:
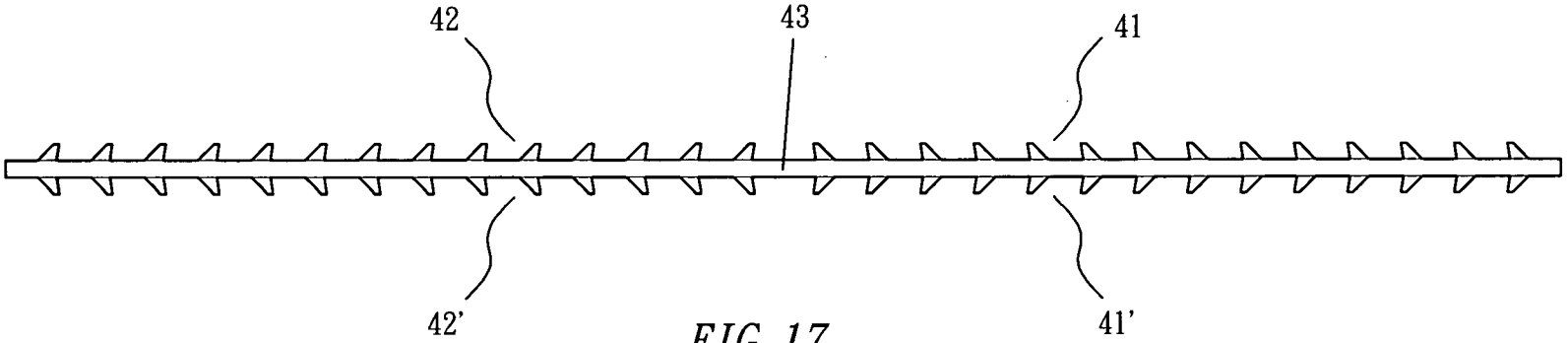
FIG. 17 is a side view of the first modified example of the second exemplified embodiment of the present invention.
Figure 18:
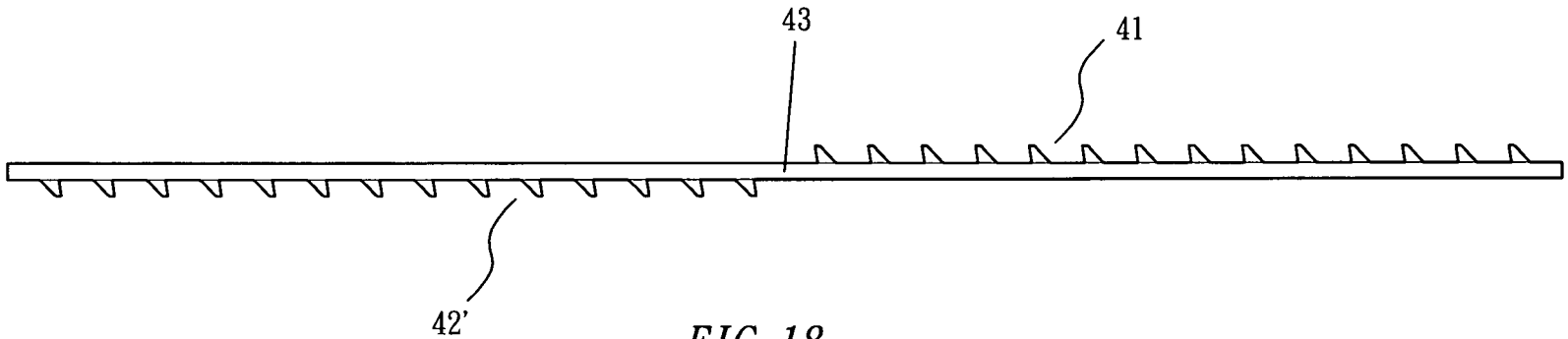
FIG. 18 is a side view of the second modified example of the second exemplified embodiment of the present invention.

A bar-like form tying article 4, shows in FIG. 15, could have many varieties shown in FIGS. 17 & 18, where FIG. 17 shows that the tying article is provided with ratchet sets 41, 42, 41' and 42' on the top and bottom edges of different bar-like bodies. FIG. 18 remains the ratchet sets 41 and 42' (or 41' and 42) of different edges at different bar-like bodies, where these two varieties in binding article and in achieving the expected functioning are exactly same as those in FIGS. 14~16.

From the aforementioned description, no matter the tying article of the present invention is shaped into a loop-like form in FIGS. 5, 6, 9~13, or shaped into a bar-like form in FIGS. 15, 17 and 18, the material adopted is to be flexible after the forming and resilient after exertion of force, where the characteristics of its structure lie in that the tying article has at least two sets of ratchet sets formed on its body, which are distributed along the two sides separated by a boundary piece and each side has at least one bar-like body. Each ratchet set is made up of at least two ratchets, for the adjustment of the tightness of the binding. When the tying article being in horizontal stick-like form condition, the seizing faces of the ratchets of the same ratchet set on each bar-like body are all facing to the same boundary piece. Once the binding is formed, the tying article can be divided into two parts. The first part is the enclosing part that loops the tied article, and the second part is the extending part which is protruded from the enclosing part. The extending part is further divided into two branches, where each branches has ratchets corresponding to the enclosing part, and the seizing faces all face the enclosing part. A portion of the enclosing part of the tying article clenched by the corresponding ratchet is available to serve as the detent. The portion served as the detent will function the same after it is being twisted, for always available in handling the binding. The included angles between the horizontal central line of the tying article body and a face of the ratchet will be ≦90° for one, and >90° for the other.

To sum up, the disclosed techniques and the structural traits of the present invention was not known in the art, and it absolutely can accomplish the expected inventive objective and the function of usage, which is construed as compliant to the requirements of a utility patent, may obtain a patent according to the patent law.

What is claimed is:

1. A tying article, used for binding an object, which tying article is a flexible and slightly resilient closed loop which when collapsed forms a shape of a bar having two sides and, where the tying article has at least two sets of ratchet sets that are all-in-one formed on its surface, which are distributed along the surface separated by boundary pieces, where the ratchet set of each side of the collapsed bar-shaped body is made up of at least two ratchets, when the tying article being horizontally orientated the seizing faces of the ratchets of the same ratchet set on each side of the collapsed bar-shaped body are all facing to the same boundary piece, and wherein the tying article is shaped into a loop-shaped tying form and the boundary pieces separating two different sides, where each side has at least one bar-shaped body which is connected with the boundary piece, as force being exerted on the boundary piece to put the bar-shaped bodies in juxtaposition, the arrangement of the ratchets of every ratchet set on the bar-shaped bodies is based on the manner that the seizing faces of the ratchets of the same ratchet set on each bar-shaped body are all facing the same boundary piece, and the seizing faces of the ratchets of every ratchet set at the same edge on the bar-shaped bodies are all facing the same boundary piece;

and wherein binding is effective, the tying article being folded into two parts, the first part is an enclosing part that loops the tied article, and the second part is an extending part that protrudes from the enclosing part, where the extending part is again divided into two branches, where the seizing face of a corresponding ratchet of each branch, clenched by the enclosing part, faces the enclosing part, which makes the ratchet seize the enclosing part that acts as a detent, to prevent the shrinking of the extending part.

2. A tying article as in claim 1 wherein the enclosing part, which is the part that the tying article loops the tied article, provides a portion as the detent which clenches the seizing faces of the corresponding ratchets located in at least two branches of the extending part.

3. A tying article as in claim 2, wherein the detent functions the same even after it being twisted for some angle.

4. A tying article as in claim 1 wherein the included angles between a horizontal central line of the tying article body and a face of the ratchet is ≦90° for one, and >90° for the other.

* * * * *